US006171136B1

(12) United States Patent
Liu et al.

(10) Patent No.: US 6,171,136 B1
(45) Date of Patent: Jan. 9, 2001

(54) MALE TYPE USB CONNECTOR

(75) Inventors: Yun-Yu Liu; Ming Kuei Li, both of Taipei (TW)

(73) Assignee: Northstar Farest Corp., Taipei (TW)

( * ) Notice: Under 35 U.S.C. 154(b), the term of this patent shall be extended for 0 days.

(21) Appl. No.: 09/248,717

(22) Filed: Feb. 10, 1999

(30) Foreign Application Priority Data

Aug. 31, 1998 (TW) ..... 87214325

(51) Int. Cl.[7] ..... H01R 13/58
(52) U.S. Cl. ..... 439/466; 439/465
(58) Field of Search ..... 439/466, 465, 439/468, 473

(56) References Cited

U.S. PATENT DOCUMENTS 5,315,062 5/1994 Hoshino ..... 174/52.1

FOREIGN PATENT DOCUMENTS 2234397 12/1972 (DE) .

*Primary Examiner*—Paula Bradley
*Assistant Examiner*—Alexander Gilman
(74) *Attorney, Agent, or Firm*—Pro-Techtor International Services

(57) ABSTRACT

A male type USB (universal serial bus) connector includes a substantially rectangular connector body, a cable connected to the connector body and extended out of a hole at a rear side wall of the connector body, two symmetrical insulative shells fastened together and covered on the rear side wall and two opposite lateral side walls of the connector body and a part of the cable to secure the cable in place, and an insulative cap fastened to the connector body and the insulative shells at a front side, the cap having a center coupling hole, which receives a front side wall of the connector body, and a backward coupling flange coupled to the insulative shells.

5 Claims, 3 Drawing Sheets

MALE TYPE USB CONNECTOR

BACKGROUND OF THE INVENTION

The present invention relates to USB (universal serial bus) connectors, and more particularly to a male type USB connector which comprises a connector body, two symmetrical insulative shells covered on rear and lateral side walls of the connector body to secure a cable to the connector body, and a front cap fastened to the connector body at a front side and coupled to the insulative shells.

An USB (universal serial bus) is a standard data transmission media commonly used in communication products, particularly computers and the related peripheral equipment, for the advantages of higher data transmission speed than earlier RS232 connectors, ease of installation and maintenance. A connector for use in a USB is called a USB connector. A USB connector is generally comprised of a connector body, a cable connected to the connector body, and an insulative shell covered on the connector body and a part of the cable to secure the connector body and the cable together. Because the insulative shell is directly molded on the connector body and a part of the cable, molten plastics may pass through gaps in the connector body during the molding process, causing the terminals of the connector body to be covered with residual plastics. It is complicated to clear residual plastics from the terminals.

SUMMARY OF THE INVENTION

The present invention has been accomplished to provide a male type USB connector which eliminates the aforesaid problem. It is one object of the present invention to provide a male type USB connector which can be quickly assembled to secure the cable to the connector body without through a molding process. It is another object of the present invention to provide a male type USB connector which is inexpensive to manufacture, and to assemble. According to one aspect of the present invention, the male type USB connector is comprised of a substantially rectangular connector body, a cable connected to the connector body and extended out of a hole at a rear side wall of the connector body, two symmetrical insulative shells fastened together and covered on the rear side wall and two opposite lateral side walls of the connector body and a part of the cable to secure the cable in place, and an insulative cap fastened to the connector body and the insulative shells at a front side, the cap having a center coupling hole, which receives a front side wall of the connector body, and a backward coupling flange coupled to the insulative shells. According to another aspect of the present invention, two packing strips are respectively inserted into the gaps in between the backward coupling flange of the cap and the peripheral walls of the connector body to secure the connection. According to still another aspect of the present invention, the insulative shells are fastened together by plugging respective plug rods at one insulative shell into respective plug holes at the other insulative shell. According to still another aspect of the present invention, the insulative cap is sealed to the insulative shells by a ultrasonic heat sealing apparatus after its installation.

DETAILED DESCRIPTION OF THE PREFERRED EMBODIMENT

Figure 1:
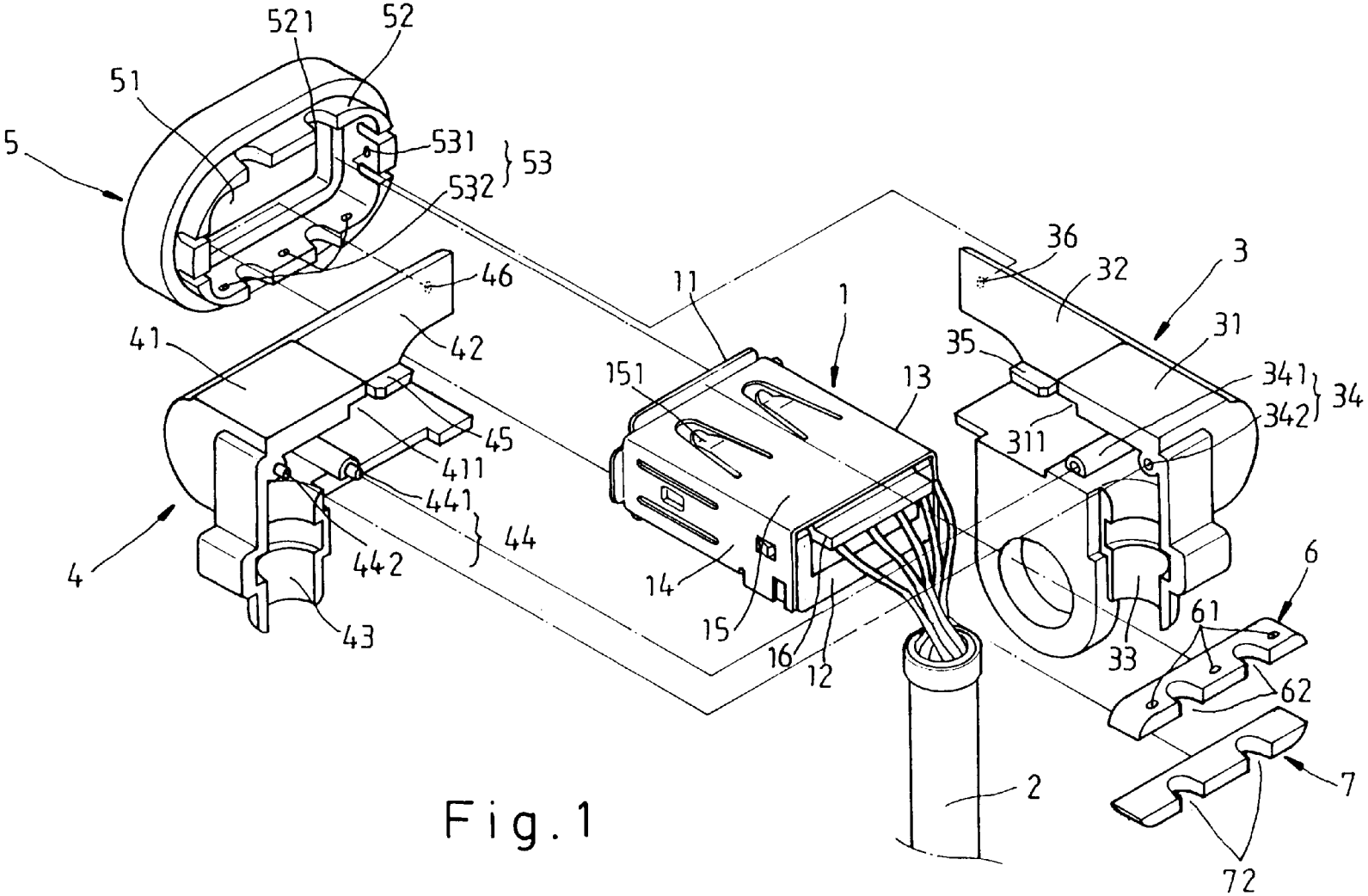
FIG. 1 is an exploded view of a male type USB connector according to the present invention.

Referring to FIG. 1, a male type USB connector is shown comprised of a connector body 1, a cable 2, a first insulative shell 3, a second insulative shell 4, an insulative cap 5, a first packing strip 6, and a second packing strip 7.

The connector body 1 comprises a vertical front side wall 11, a vertical rear side wall 12, horizontal top and bottom side walls 15 connected between the front side wall 11 and the rear side wall 12 at different elevations, two opposite vertical lateral side walls 13,14 bilaterally connected between the front side wall 11 and the rear side wall 12, a transverse rail 16 provided at the rear side wall 12, and a plurality of forwardly extended projecting spring strips 151 respectively provided at the horizontal top and bottom side walls 15 for connection with the matching connector (not shown).

The cable 2 is inserted into the connector body 1 through a hole on the vertical rear side wall 12, having a plurality of conductors 22 respectively connected to respective terminals (not shown) in the connector body 1.

The insulative shell 3 or 4 comprises a hollow base 31 or 41, a transverse coupling groove 311 or 411 at the hollow base 31 or 41, a front extension wall 32 or 42 forwardly extended from one end of the hollow base 31 or 41 for covering one lateral side wall 13 or 14 of the connector body 1, a rear receptacle portion 33 or 43 downwards extended from an opposite end of the hollow base 31 or 41 for receiving the cable 2, a transverse locating groove 331 or 431 at the rear receptacle portion 33 or 43 for receiving a binding ring 21 at the cable 2, a locating block 35 or 45 raised from the hollow base 31 or 41 at an inner side for positioning in a hole at one lateral side wall 13 or 14 of the connector body 1, and positioning means for example a raised portion 36 or 46 raised from the front extension wall 32 or 42 at an outer side, and coupling means 34 or 44. The coupling means 34 of the first insulative shell 3 comprises a plurality of plug holes 341,342. The coupling means 44 of the second insulative shell 4 comprises a plurality of plug rods 441,442 corresponding to the plug holes 341,342 at the first insulative shell 3. By plugging the respective plug rods 441,442 into the respective plug holes 341,342, the first insulative shell 3 and the second insulative shell 4 are fastened together.

The insulative cap 5 comprises a center coupling hole 51 for receiving the front side wall 11 of the connector body 1, a backward coupling flange 52 raised from the back side thereof around the center coupling hole 51, a plurality of notches 521 at the backward coupling flange 52 corresponding to the forwardly extended projecting sprint strips 151 of the connector body 1, and positioning means 53. The positioning means 53 comprises a plurality of recessed holes 531 for engagement with the raised portions 36,46 of the insulative shells 3,4, and recessed holes 532.

Figure 4:
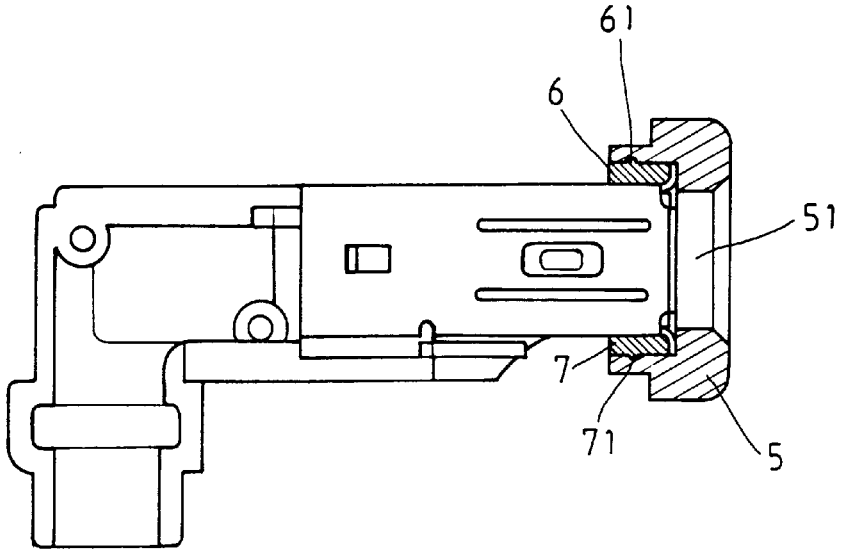
FIG. 4 is a side plain view of the present invention, showing the male type USB connector assembled.

The packing strip 6 or 7 comprises a plurality of raised portions 61 or 71 (see also FIG. 4) for engagement with the recessed holes 532 at the cap 5 and a plurality of notches 62 or 72 corresponding to the notches 521 at the cap 5.

Figure 2C:
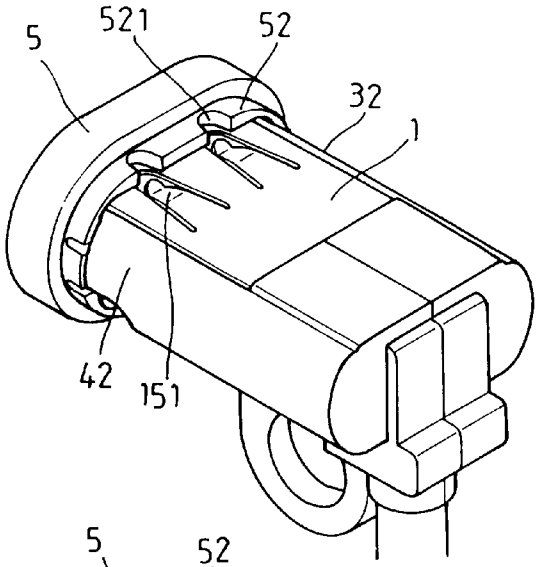
FIG. 2C is an assembly view of the present invention, showing the insulative shells covered on the connector body and the cable and the cap covered on the connector body and the insulative shells.
Figure 2D:
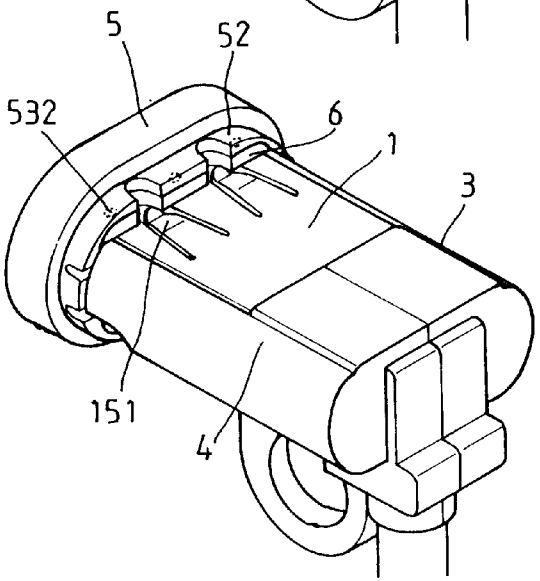
FIG. 2D is an assembly view of the present invention, showing the connector body, the cable, the insulative shells, the insulative cap and the packing strips fastened together.
Figure 2A:
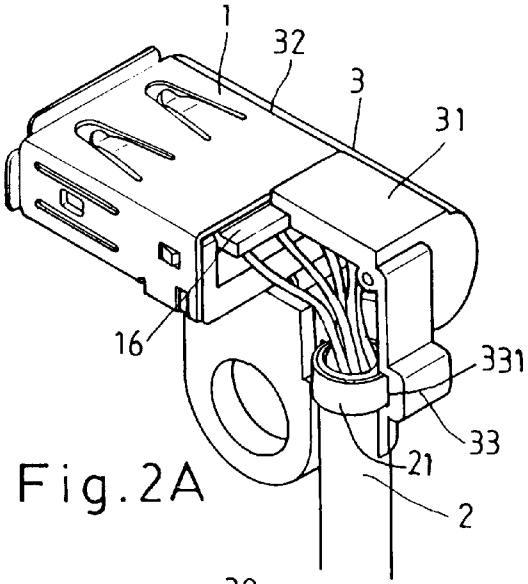
FIG. 2A is an assembly view of the present invention, showing the cable and the first insulative shell connected to the connector body.
Figure 2B:
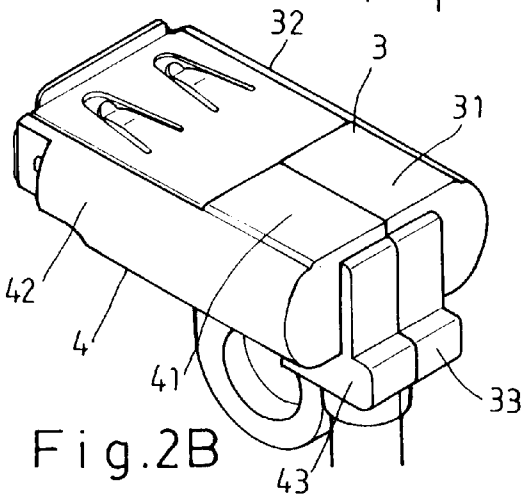
FIG. 2B is an assembly view of the present invention, showing the insulative shells covered on the connector body and the cable.
Figure 3:
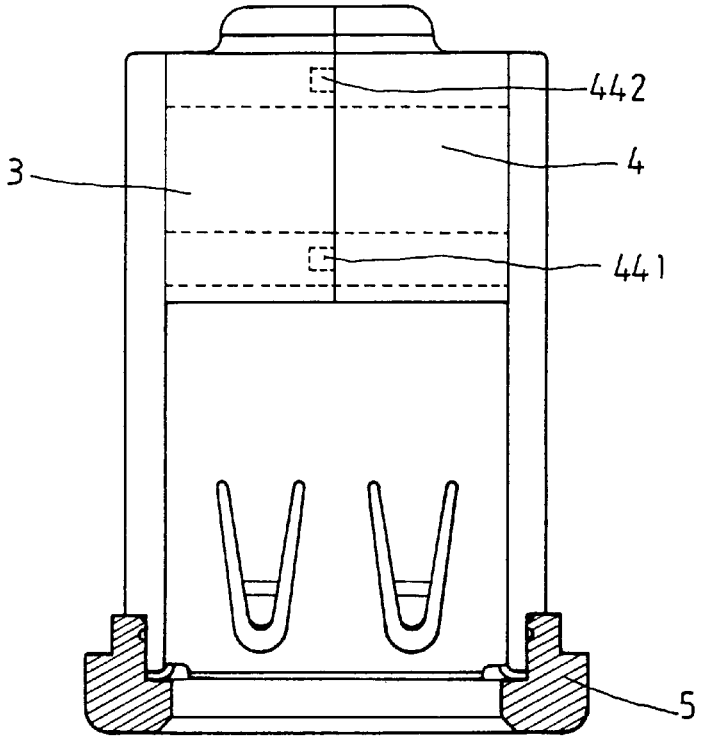
FIG. 3 is a top plain view of the present invention, showing the male type USB connector assembled.

Referring to Figures from 2A through 4, the insulative shells 3,4 are respectively attached to the connector body 1 from both sides by forcing the respective transverse coupling grooves 311,411 of the insulative shells 3,4 into engagement with the transverse rail 16 of the connector body 1, permitting the plug rods 441,442 of the second insulative shell 4 to be respectively plugged into the plug holes 341,342 of the first insulative shell 3 (see FIGS. 2A, 2B and 3). When the insulative shells 3,4 and the connector body 1 are fastened together, the front extension walls 32,42 of the insulative shells 3,4 are respectively covered on the lateral side walls 13,14 of the connector body 1, the rear receptacle portions 33,43 are abutted against each other to hold the cable 2 in plate, and the binding ring 21 of the cable 2 is retained in the transverse grooves 331,431 of the receptacle portions 33,43 to stop the cable 2 from backward displacement. The cap 5 is then fastened to the front side wall 11 of the connector body 1 and covered on the front extension walls 32,42 of the insulative shells 3,4, permitting the recessed holes 531 to be respectively forced into engagement with the raised portions 36,46 of the insulative shells 3,4 (see FIG. 2C). After installation of the cap 5, the cap 5 is sealed to the insulative shells 3,4 by a high-frequency heat sealing apparatus. Then, the packing strips 6,7 are respectively inserted into the gaps in between the backward coupling flange 52 of the cap 5 and the horizontal top and bottom side walls 15 of the connector body 1, permitting the raised portions 61,71 of the packing strips 6,7 to be respectively forced into engagement with the recessed holes 532 at the backward coupling flange 52 of the cap 5 (see FIGS. 2D and 4). When assembled, the projecting spring strips 151 of the connector body 1 are respectively suspended in the notches 521,62,72.

While only one embodiment of the present invention has been shown and described, it will be understood that various modifications and changes could be made thereunto without departing from the spirit and scope of the invention disclosed.

What the invention claimed is:

1. A male type universal serial bus connector comprising:

a connector body, said connector body comprising a front side wall, a rear side wall, a top side wall and a bottom side wall connected between said front side wall and said rear side wall at different elevations and two lateral side walls connected between said front side wall and said rear side wall at two opposite lateral sides;

a cable connected to said connector body and extended out of a hole at the rear side wall of said connector body;

two symmetrical insulating shells fastened together and covered on the lateral side walls and rear side wall of said connector body and a part of said cable to secure said cable to said connector body;

an insulating cap fastened to said connector body and said insulating shells at a front side, said cap comprising a center coupling hole, which receives the front side wall of said connector body and a backward coupling flange raised from a back side thereof around said center coupling hole and coupled to said insulating shells; and two packing strips mounted between the backward coupling flange of said cap and the top bottom side wall of said connector body.

2. A male type universal serial bus connector comprising:

a connector body, said connector body comprising a front side wall, a rear side wall, a top side wall and a bottom side wall connected between said front side wall and said rear side wall at different elevations and two lateral side walls connected between said front side wall and said rear side wall at two opposite lateral sides;

a cable connected to said connector body and extended out of a hole at the rear side wall of said connector body;

two symmetrical insulating shells fastened together and covered on the lateral side walls and rear side wall of said connector body and a part of said cable to secure said cable to said connector body;

an insulating cap fastened to said connector body and said insulating shells at a front side, said cap comprising a center coupling hole, which receives the front side wall of said connector body and a backward coupling flange raised from a back side thereof around said center coupling hole and coupled to said insulating shells; and wherein said insulating shells each comprise a hollow base, a front extension wall extended forward from one end of said hollow base and covering one lateral side wall of said connector body, a rear receptacle portion extended downward from an opposite end of said hollow base to hold a part of said cable; and said front extension walls of said insulating shells each comprise at least one male positioning means, and said cap comprises a plurality of female positioning means provided at said backward coupling flange for engagement with the male positioning means at the front extension walls of said insulating shells.

3. The male type USB connector of claim 2 wherein the male positioning means at said insulative shells are raised portions, and the female positioning means at the backward coupling flange of said cap are recessed holes which receive the raised portions of said insulative shells.

4. A male type universal serial bus connector comprising:

a connector body, said connector body comprising a front side wall, a rear side wall, a top side wall and a bottom side wall connected between said front side wall and said rear side wall at different elevations and two lateral side walls connected between said front side wall and said rear side wall at two opposite lateral sides;

a cable connected to said connector body and extended out of a hole at the rear side wall of said connector body;

two symmetrical insulating shells fastened together and covered on the lateral side walls and rear side wall of said connector body and a part of said cable to secure said cable to said connector body;

an insulating cap fastened to said connector body and said insulating shells at a front side, said cap comprising a center coupling hole, which receives the front side wall of said connector body and a backward coupling flange raised from a back side thereof around said center coupling hole and coupled to said insulating shells; and two packing strips mounted between the backward coupling flange of said cap and the top bottom side wall of said connector body, said packing strips each have a plurality of raised portions, and the backward coupling flange of said cap has a plurality of recessed holes respectively engaged with the raised portions of said packing strips.

5. The male type USB connector of claim 4, wherein the backward coupling flange of said cap has a plurality of peripheral notches, and said packing strips have a plurality of peripheral notches corresponding to the peripheral notches at the backward coupling flange of said cap.

* * * * *